US008388098B2

(12) United States Patent
Govyadinov et al.

(10) Patent No.: US 8,388,098 B2
(45) Date of Patent: Mar. 5, 2013

(54) PRINTING ORIFICE HEALTH DETECTION DEVICE

(75) Inventors: Alexander Govyadinov, Corvallis, OR (US); William J. Allen, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 164 days.

(21) Appl. No.: 13/002,601

(22) PCT Filed: Jul. 23, 2008

(86) PCT No.: PCT/US2008/008954

§ 371 (c)(1), (2), (4) Date: Jan. 4, 2011

(87) PCT Pub. No.: WO2010/011202

PCT Pub. Date: Jan. 28, 2010

(65) Prior Publication Data

US 2011/0109679 A1 May 12, 2011

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS

| | | | | |
|---|---|---|---|---|
| 5,646,654 | A * | 7/1997 | Widder | 347/14 |
| 6,561,614 | B1 * | 5/2003 | Therien et al. | 347/19 |
| 6,692,099 | B2 | 2/2004 | Rio Doval | |
| 7,104,634 | B2 | 9/2006 | Weksler | |
| 7,121,642 | B2 | 10/2006 | Stoessel | |
| 2002/0089561 | A1 * | 7/2002 | Weitzel et al. | 347/19 |
| 2002/0158938 | A1 | 10/2002 | Doval | |
| 2003/0117455 | A1 | 6/2003 | Brunch | |
| 2007/0064034 | A1 | 3/2007 | Hawkins | |
| 2007/0195120 | A1 | 8/2007 | Kim | |
| 2007/0200889 | A1 | 8/2007 | Iriguchi | |
| 2008/0012909 | A1 | 1/2008 | Matsuda | |

* cited by examiner

*Primary Examiner* — Julian Huffman

(57) ABSTRACT

A detection device (10) including a drop detection device (22) positioned to receive drop ejection information as drops are ejected from the multiple orifices (18) of a drop ejection device (16), and a controller (34) that receives the drop ejection information and conducts a mathematical calculation to calculate frequency domain information from the drop ejection information to produce orifice information.

14 Claims, 3 Drawing Sheets

PRINTING ORIFICE HEALTH DETECTION DEVICE

BACKGROUND

Printing devices, such as thermal ink jet printers, may include orifice plates including multiple orifices therein. A determination of orifice health, i.e., if an individual orifice is occluded, and if so, to what extent, may be periodically determined so as to schedule orifice plate maintenance. Testing individual ones of the multiple orifices sequentially may be time consuming. There is a need, therefore, to speed up the process of the determination of orifice health in printing devices.

DETAILED DESCRIPTION OF THE DRAWINGS

Figure 1:
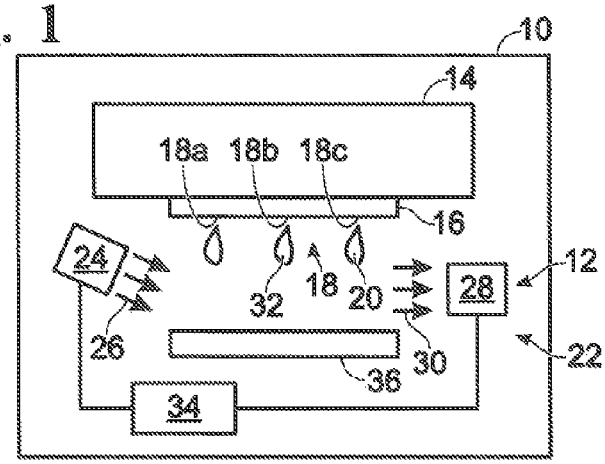
FIG. 1 is a schematic side cross-sectional view of one example embodiment of a printing device including one example embodiment of a printing orifice health detection device.

FIG. 1 is a schematic side cross-sectional view of one example embodiment of a printing device 10 including one example embodiment of a printing orifice health detection device 12. Printing device 10 may be any type of printing or imaging device, and in the example embodiment shown, may be a thermal ink jet printer. Printing device 10 may include a printhead 14 that may include a orifice plate 16 including multiple orifices 18 therein for ejecting ink 20 therefrom. Orifice plate 16 may include several orifices 18 or may include thousands of orifices 18, as may be suited for a particular application.

A determination of orifice health, i.e., if an individual one 18*a* of multiple orifices 18 is occluded, and if so, to what extent, may be periodically determined so as to schedule orifice plate 16 maintenance. Testing individual ones of the multiple orifices 18 sequentially may be time consuming, especially in applications wherein the orifice plate 16 includes hundreds or more of individual orifices 18. The printing orifice health detection device 12 may be used to speed up the process of the determination of orifice health.

Health detection device 12 may include a drop detection device 22. Drop detection device 22 may include a light emitting device 24 that emits a light 26, and a light detecting device 28 positioned with respect to orifice plate 16 such that light detecting device 28 receives light 30 reflected, scattered and/or diffracted from drops 32 of ink 20 ejected from orifice plate 16 and illuminated by light 26. Light detecting device 28 may be connected to a controller 34 that may conduct a mathematical operation on the light information received from light 30, so as to simultaneously determine the health of multiple ones of individual orifices 18 of orifice plate 16. In the embodiment shown, for example, detection device 22 is a light based detected device. However, drop detection device 22 may be an electrostatic device, a capacitive device, an acoustic device, a magnetic detection device, an optical device, or any other drop detection device that will function for a particular application.

In one example embodiment, light emitting device 24 may be a light scattering drop detector including a laser beam 1 millimeter (mm) in diameter wherein at a drop velocity of 10 m/second, the expected time-of-flight (TOF) is 100 micro seconds (μsec). Light detecting device 28 may be a single channel photocell or a photocell array (FIG. 8) that is capable of detecting up to 5,000 to 8,000 drop-events per second. A 0.1 mm laser beam diameter in the same detector may be capable of detecting up to 50,000 to 80,000 drop-events per second. In such an embodiment, the printhead 14 may eject a stream of ink droplets 32 simultaneously from multiple ones of orifices 18. Stream of ink droplets 32 may also be referred to as a burst of a series of ink drops. As the drops 32 fall, light from laser diode 24 illuminates the drop 32, and light 30 scattered from the drops is detected by photo cell 28. The drops 32 may continue to fall into a drop collection reservoir 36 for later use in printing device 10, such that the ink is not wasted and such that printing on a print media may not be conducted during the orifice health determination process. In another embodiment the ink may be ejected onto a print media, such as a sheet of print media, rather than into a collection reservoir or the like.

Figure 2:
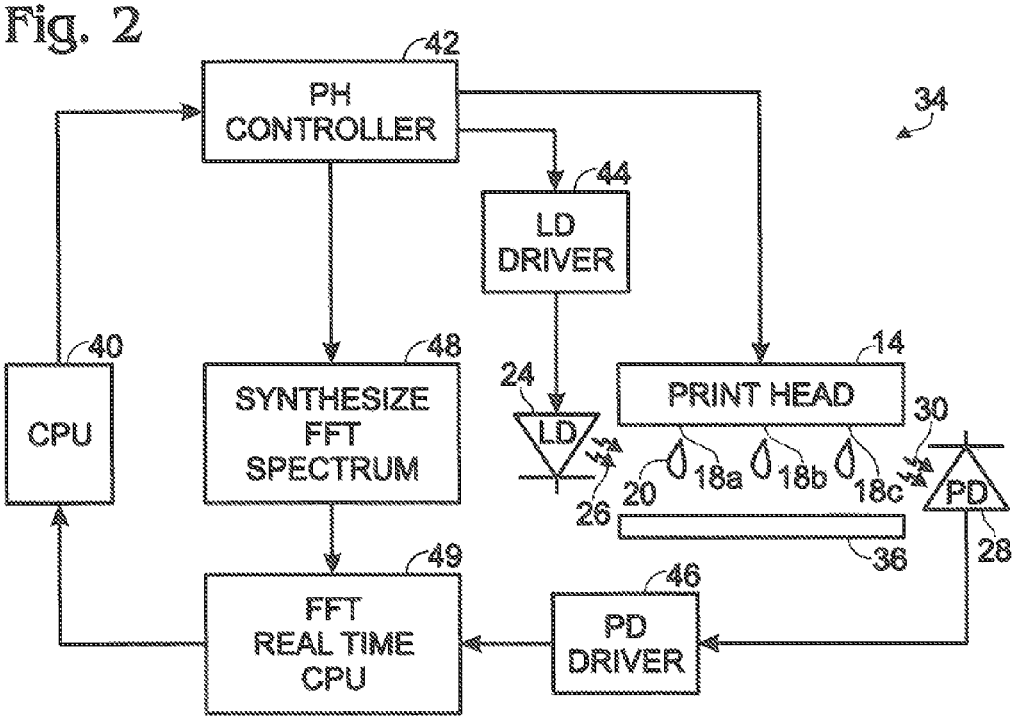
FIG. 2 is a block diagram of the components and steps of one example embodiment of a printing orifice health detection device and method.

FIG. 2 is a block diagram of the components of one example embodiment of a printing orifice health detection device 12 and process of using the same. Controller 34 may include a central processing unit (CPU) or digital signal processor (DSP) 40, a printhead controller 42, a light emitting diode driver 44, and a photo diode driver 46. The CPU 40 may define and send a sequence of pulses to printhead 14 to activate simultaneous ejection of multiple drops 32 through orifices 18. Light detecting device 28 may convert the information received from the optical scattering of light on drops 32 into an electrical signal that is fed to CPU 40. The CPU 40 may then, in step 48, execute a discrete Fourier transform (DFT), a discrete cosine transform (DCT), or a real time fast Fourier transform (FFT) transformation, for example, of the electrical signal, filter it, and in step 49, compare the generated signal with a theoretical spectrum. In other embodiments the FFT may not be conducted in real time but real time FFT calculations may result in a fast well filling process when compared to non real time FFT processes. The CPU 40 may then make a conclusion about the orifice health of individual ones of multiple orifices 18 and may thereafter initiate a cleaning, priming, and/or curing step to improve orifice health. If an individual orifice is determined to be unfixable, the CPU may send such a conclusion to a writing system of printhead 14 such that a substitution orifice 18 may be utilized to compensate for the unfixable orifice 18. For example if a particular orifice is being fired at 1.64 kHz, then the theoretical spectrum, also referred to as the expected spectrum, may show a peak at 1.64 kHz. If the generated signal does not include a peak at 1.64 kHz, then the CPU may conclude that the particular orifice is partially or fully occluded and may then generate steps to fix or compensate for the occluded orifice.

The drop detection device 22 of the present invention may allow an orifice health detection process to be carried out faster than prior art devices because multiple orifices 18 may be fired simultaneously while still allowing orifice health information to be determined for each individual orifice. Such simultaneous health detection is made possible by the use of fast Fourier transformation (FFT) of drop detection information, as will be described below.

Periodic functions may be described as an infinite sum of sine and cosine functions. Fourier equations transform periodic functions into sums of harmonics of sine or cosine functions. The various transform equations are known as Fourier transform equations. These equations have commonly been applied to functions of time. The transform is referred to as an inverting function in that the units are inverted. Accordingly, data as a function of time would be transformed to data as a function of 1/time (frequency). Real work use of these transforms considers discrete data points rather than continuous functions. The data is sampled at regular periods (the sampling rate or interval) over the interval at which the data repeats (the sampling period). The equations or algorithms for these calculations are called Discrete Fourier Transforms (DFT). The time it takes to calculate the DFT increases exponentially as more data points are considered. Mathematicians have exploited redundancies and symmetries in the DFT to reduce computation time. The results of their efforts are collectively called Fast Fourier Transforms (FFT). The fastest of these FFTs are based on equations when the number of data points happen to be an integral power of 2, the number 8 for example. One particular FFT equation utilized in the present invention is the following:

$$X[k]=N/2-1 \text{ Sum } J=0x[2j] \exp[-i2\pi ki/(N/2)]+W \exp N/2-1 \text{ Sum } J=0x[2+1] \exp[-i2\pi kj/(N/2)]; \quad \text{Equation 1}$$

where N=total number of data points, W=exp(−iπ/N).

Use of the FFT of Equation 1 above has been found to allow a determination of individual orifice health. i.e., occlusion, when ink is ejected simultaneously from multiple orifices. The FFT has been found to allow a very quick determination of individual orifice health when attempting to simultaneously eject a series of ink drops from eight orifices 18. An example of the process is described with respect to FIG. 3, wherein a series of ink drops are fired simultaneously from three orifices.

Figure 3:
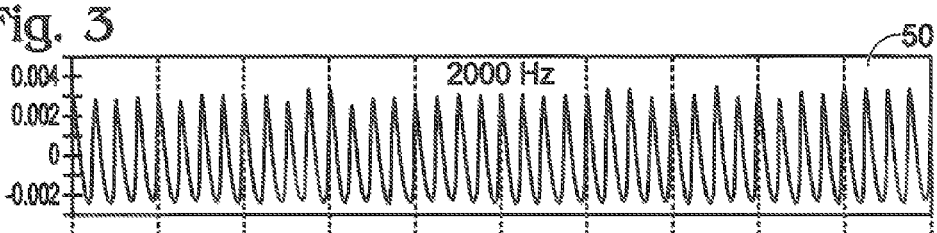
FIGS. 3-5 are graphs illustrating drops detected from three different orifices.
Figure 4:
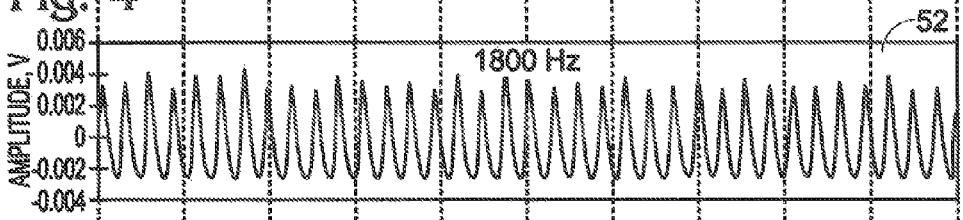
Figure 5:
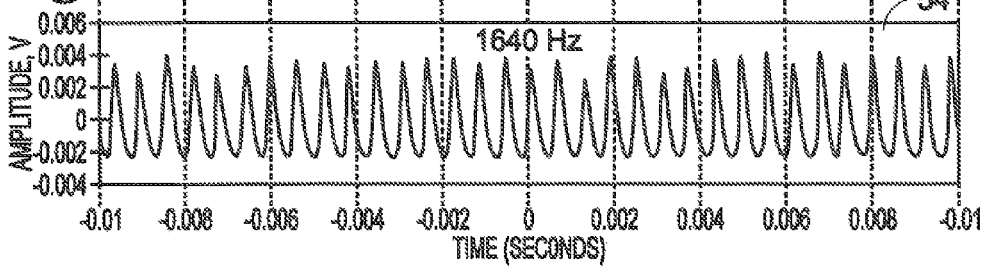

FIGS. 3-5 are graphs illustrating the drop detection information received from simultaneous firing of a series of ink drops from three orifices 18*a*, 18*b* and 18*c*. Graph 50 of FIG. 3 shows the amplitude in volts of a first nozzle 18*a* fired at 2.0 kHz. Graph 52 of FIG. 3 shows the amplitude in volts of a second nozzle 18*b* simultaneously fired with first nozzle 18*a*, at a frequency of 1.8 kHz. Graph 54 of FIG. 3 shows the amplitude in volts of a third nozzle 18*c* simultaneously fired with first nozzle 18*a* and second nozzle 18*b*, at a frequency of 1.64 kHz. These three graphs each represent the information that would be received from a drop detection device if only one orifice was fired at a time, i.e. sequentially firing the orifices. However, in the process of the present invention, orifices may be fired simultaneously thereby providing drop detection device 22 with information simultaneously for all orifices being fired.

Figure 6:
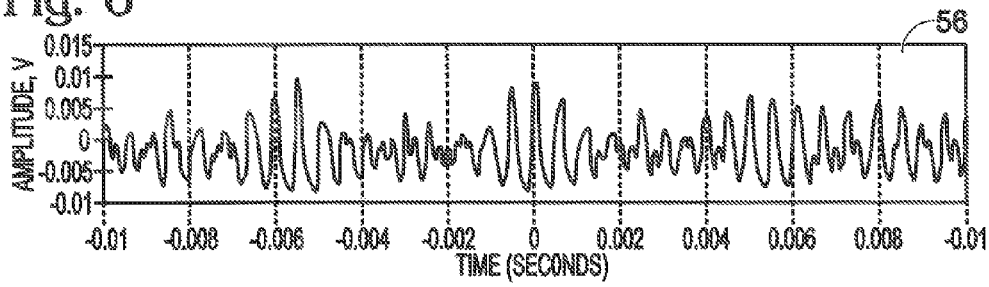
FIG. 6 is a summation of the drop detection information of FIGS. 3-5.

FIG. 6 shows graph 56 including the information received by drop detection device 22 when the three orifices of the example are fired simultaneously, i.e., a summation of the information of the three amplitude graphs 50, 52 and 54 (FIGS. 3-5).

Figure 7:
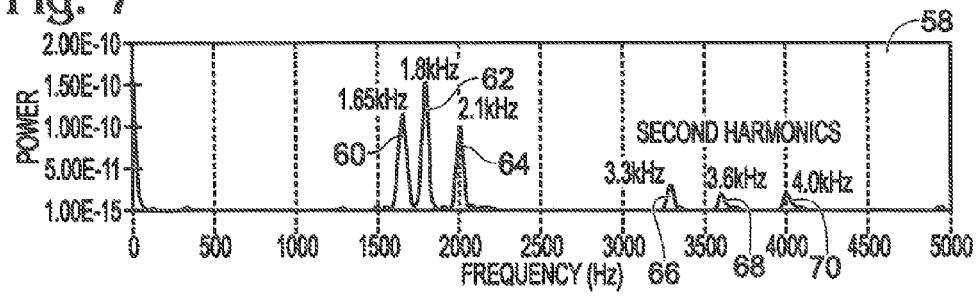
FIG. 7 shows the fast Fourier transform (FFT) results for deconvolution of information from three orifices fired simultaneously, as shown in FIG. 6.

FIG. 7 shows graph 58 including the fast Fourier transform (FFT) results for deconvolution of three orifices fired simultaneously. The FFT deconvolution of the summation of graph 56 (FIG. 6) forms a spectral power graph from the summation data, wherein three power peaks are shown: peak 60 of 1.64 kHz, representing the nozzle fired in graph 54, peak 62 of 1.8 kHz, representing the nozzle fired in graph 52, and peak 64 of 2.1 kHz, representing the nozzle fired in graph 50. When compared with an expected for theoretical spectrum, the presence of each of peaks 60, 62 and 64 is an indication that each of nozzles 18*a*, 18*b* and 18*c* are each firing and are not occluded. Conversely, if a peak is not shown at a particular frequency, but is expected at that frequency based on CPU controlled firing of a particular orifice at that frequency, then the CPU will make a determination that the orifice firing at the particular frequency is not functioning. In other words, use of simultaneous firing of multiple orifices, each at a unique frequency, phase or other distinct and/or measurable quality, and then conducting a FFT transform of the summation will provide accurate orifice health information for each particular orifice. In this example wherein three orifices are fired simultaneously, the health determination process is speed up by approximately three times when compared to prior art orifice health detection methods wherein individual orifices are fired sequential. In one example wherein eight orifices are fired simultaneously, the health determination process is speed up by approximately eight times when compared to prior art orifice health detection methods wherein individual orifices are fired sequentially.

As shown in the example above, use of FFT transforms may demonstrate 100% and/or very high recognition probabilities. For example, three peaks are shown in graph 58 that correspond to the three orifices that were fired, as shown in graphs 50, 52 and 54.

In the process described above, ink aerosol droplets may have a lower speed and generate a low frequency signal which can be filtered by a low-pass filter and/or used for jetted drop quality evaluation based on information about fast and slow moving drops and droplets.

In another embodiment, multiple orifices 18 may be fired simultaneously with a series of ink drops, each fired at a unique phase, instead of at a unique frequency, wherein the summation of the results may be subjected to FFT deconvolution, to form a frequency spectrum from which individual orifice health can be determined.

The spacing between frequencies, for example, at which the multiple orifices are fired, may be dependent upon the signal to noise ratio of the system, the output signal received, the temporal resolution and/or the sampling rate utilized, for example. Testing of several example methods has shown that a frequency spacing of approximately 100 Hz or more provides sufficient discrete separation of data information to determine individual orifice health. For reliable nozzle/orifice detection every nozzle may fire at least 3-5 drops per burst at any given frequency.). The frequency resolution may be a function of signal strength, signal to noise ratio, Analogue-to-digital conversion resolution and other apparatus functions and theoretically can be infinitely small. For practical applications, as mentioned above, a 100 Hz frequency spacing may be sufficient. However, a much smaller frequency spacing may be utilized than 100 Hz.

Referring again to graph 58 of FIG. 7, the signal strength of peaks 60, 62 and 64 is proportional to the drop volume ejected by the corresponding orifice. The signal strength is related to the flow rate of liquid ejected by the corresponding orifice. A higher drop ejection rate (number of drops ejected per second, for example) increase the signal strength. Ejection of drops with a larger volume also increases the signal strength. Accordingly, a variety of drop ejection information can be determined by the FFT deconvolution described above.

Real time FFT analysis enables real time continuous multiple orifice health monitoring for some applications, such as precision dispensing, automatic liquid handling, and the like.

Figure 8:
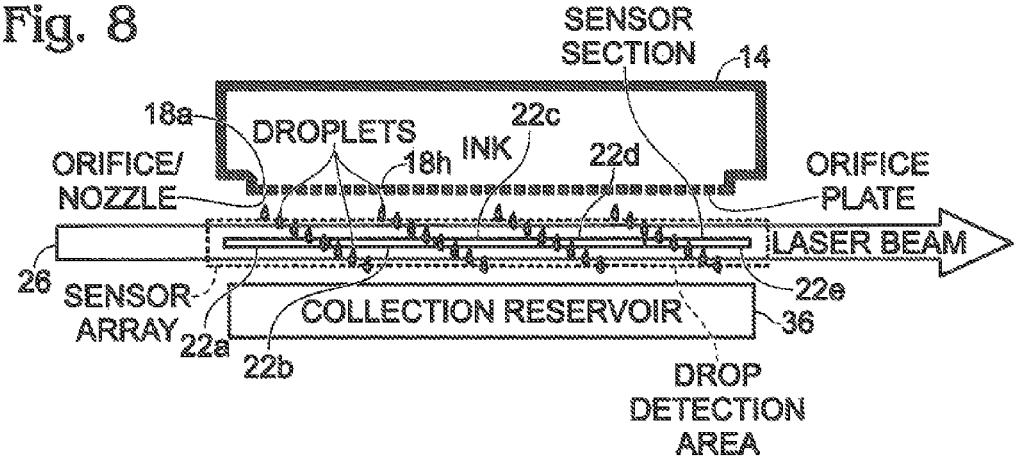
FIG. 8 is a schematic side cross-sectional view of one example embodiment of a printing device including an array of drop detectors that detect drops ejected from eight orifices fired simultaneously.

FIG. 8 is a schematic side cross-sectional view of one example embodiment of a printing device 10 including an array 22*a*-22*e* of drop detectors that detect drops ejected from eight orifices 18*a*-18*h*, fired simultaneously. Each section 22*a*-22*e* of drop detection device array 22 may be positioned to receive drop information for a different region of printhead 14. In the embodiment of a photocell array/multi-channel detector 22 the use of an array/multi-channels enables higher throughput of the detection system because of the parallel detection of drops that are ejected from different zones of the orifice plate 16. For example, each of detectors 22*a*-22*e* may obtain signal information from spatially separated, but partially overlapped zones of orifice plate 16. The firing system of orifice plate 16 may be controlled to eject drops from partially overlapping zones of orifice plate 16 in such a manner to avoid significant crosstalk of detected signals by detectors 22*a*-22*e*, for example. Accordingly, use of a detection device array 22 may enable print zone multiplexing that may increase drop detector throughput.

Figure 9:
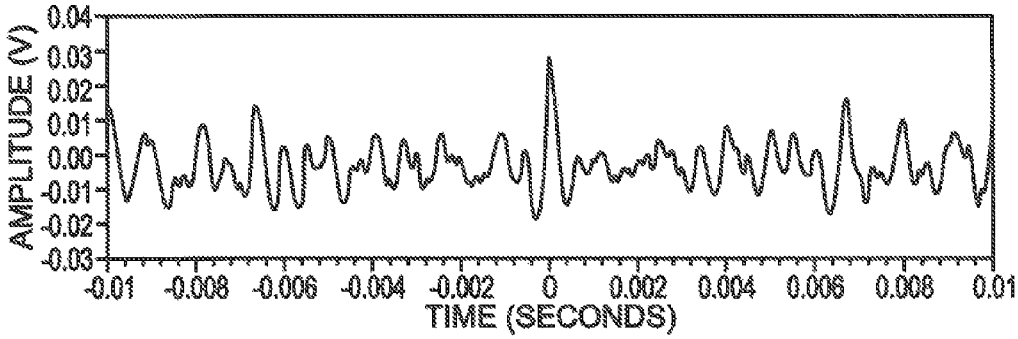
FIG. 9 is a summation of the drop detection information gathered in the embodiment of FIG. 8.

FIG. 9 is a summation of the drop detection information gathered in the embodiment of FIG. 8 wherein eight orifices are fired simultaneously.

Figure 10:
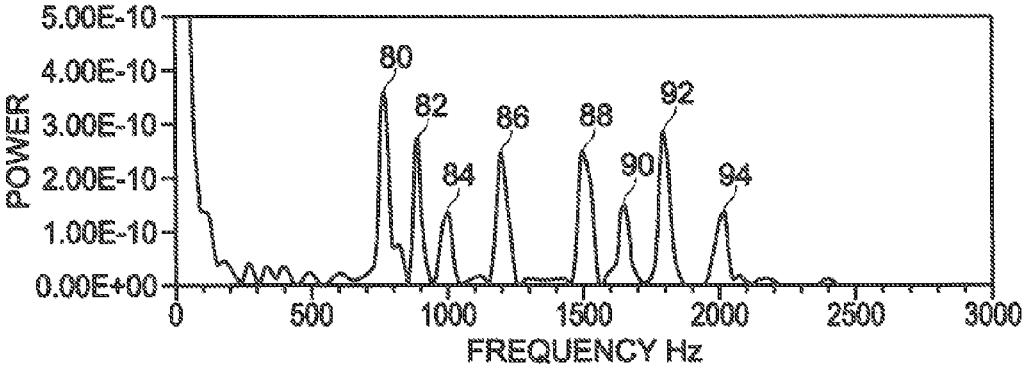
FIG. 10 shows the fast Fourier transform (FFT) results for deconvolution of information from eight orifices fired simultaneously, as shown in FIG. 9.

FIG. 10 shows the fast Fourier transform (FFT) results for deconvolution of information from the eight orifices 18*a*-18*h* fired simultaneously, as shown in FIG. 9. Each of peaks 80-94 represent the drop information fired from a corresponding one of orifices 18*a*-18*h*. Based on the peak information created by the FFT results, CPU 40 may determine the orifice health of each of orifices 18*a*-18*h*.

Other variations and modifications of the concepts described herein may be utilized and fall within the scope of the claims below.

We claim:

1. A detection device (10), comprising:

a drop detection device (22) positioned to receive drop ejection information as drops are ejected from multiple orifices (18) of said drop ejection device; and a controller (34) that receives said drop ejection information and conducts a mathematical calculation to calculate frequency domain information from said drop ejection information to produce orifice information;

wherein said drop detection device (22) includes an array of detection devices wherein each element of said array obtains a signal from spatially separated zones of an orifice plate and wherein said orifice plate is controlled to simultaneously eject drops from said multiple orifices in said spatially separated zones in a manner to reduce crosstalk of detected signals.

2. The device (10) of claim 1 further comprising a drop ejection device (16) including said multiple orifices (18) adapted for ejecting drops therefrom and wherein said orifice health information includes drop ejection information for each of said multiple orifices.

3. The device (10) of claim 2 wherein said drop ejection device (16) simultaneously ejects drops from said multiple orifices at one of a unique frequency for each orifice and a unique phase for each orifice.

4. The device (10) of claim 2 wherein said drop ejection device (16) is chosen from one of a thermal ejection device, and a piezo ejection device and wherein said drop detection device (22) is chosen from one of an electrostatic detection device, a capacitive detection device, an acoustic drop detection device, and an optical detection device.

5. The device (10) of claim 2 wherein said drop ejection device (16) simultaneously ejects drops from at least eight orifices (18).

6. The device (10) of claim 1 wherein said frequency domain information is mathematically calculated by one of the following algorithms: Discrete Fourier Transformation (DFT), a Discrete Cosine Transformation (DCT) and a Fast Fourier Transformation (FFT).

7. The device (10) of claim 6 wherein said FFT deconvolves said drop ejection information to provide a resulting frequency information including a frequency peak information for each functioning orifice of multiple orifices.

8. The device (10) of claim 7 wherein each orifice has a unique frequency separated from adjacent frequencies by at least 100 Hz.

9. The device (10) of claim 7 wherein a power measurement of each frequency peak is utilized by said controller (34) to determine a drop quality of drops ejected from each functioning orifice of multiple orifices (18).

10. A method of detecting orifice functionality, comprising:

ejecting drops from multiple orifices (18);

detecting drop ejection information from said ejecting drops, using an array of detection devices wherein each element of said array obtains a signal from spatially separated zones of an orifice plate and wherein said orifice plate is controlled to simultaneously elect drops from multiple orifices in said spatially separated zones in a manner to reduce crosstalk of detected signals; and conducting a fast Fourier transform (FFT) on said drop ejection information to produce orifice functionality information for individual ones of said multiple orifices (18).

11. The method of claim 10 wherein said ejecting drops from multiple orifices (18) comprises simultaneously ejecting drops from individual ones of said multiple orifices at a unique frequency for each orifice and wherein said step of conducting a fast Fourier transform (FFT) includes conducting a frequency domain analysis that deconvolves said drop ejection information to provide a resulting frequency information including a frequency peak for each functioning orifice of said multiple orifices and, further comprising measuring a power of each frequency peak to determine a drop quality of drops ejected from each functioning orifice of said multiple orifices.

12. The method of claim 10 wherein said step of detecting drop ejection information is conducted utilizing one of electrostatic detection, capacitive detection, acoustic drop detection, and optical detection.

13. A method of manufacturing a detection device (10), comprising:

providing a drop ejection device (16) including multiple orifices (18) adapted for ejecting drops therefrom;

positioning a drop detection device (22) to receive drop ejection information as drops are ejected from said multiple orifices of said drop ejection device, wherein said drop detection device (22) includes an array of detection devices wherein each element of said array obtains a signal from spatially separated zones of an orifice plate and wherein said orifice plate is controlled to simultaneously eject drops from multiple orifices in said spatially separated zones in a manner to reduce crosstalk of detected signals; and connecting a controller (34) to said drop detection device so as to receive said drop ejection information, said controller calculating frequency domain information on said drop ejection information to produce orifice information.

14. The method of claim 13 wherein said detection device (22) is positioned within an imaging device that produces images on print media, said drop ejection device is adapted for ejecting drops from ones of multiple orifices at a unique frequency for each orifice and wherein said calculating frequency domain information comprises utilizing one of a DFT, a DCT and a FFT.

* * * * *